US009631430B2

(12) United States Patent
Strittmatter

(10) Patent No.: US 9,631,430 B2
(45) Date of Patent: Apr. 25, 2017

(54) DRILLING ASSEMBLY WITH HIGH-SPEED MOTOR GEAR SYSTEM

(75) Inventor: Andrew Jerome Strittmatter, Edmond, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 275 days.

(21) Appl. No.: 14/391,517

(22) PCT Filed: Apr. 19, 2012

(86) PCT No.: PCT/US2012/034174
§ 371 (c)(1),
(2), (4) Date: Oct. 9, 2014

(87) PCT Pub. No.: WO2013/158096
PCT Pub. Date: Oct. 24, 2013

(65) Prior Publication Data

US 2015/0075871 A1 Mar. 19, 2015

(51) Int. Cl.
*E21B 4/00* (2006.01)
*E21B 4/02* (2006.01)
*E21B 7/00* (2006.01)

(52) U.S. Cl.
CPC ..... *E21B 4/006* (2013.01); *E21B 4/02* (2013.01); *E21B 7/00* (2013.01)

(58) Field of Classification Search
None
See application file for complete search history.

(56) References Cited

U.S. PATENT DOCUMENTS 4,080,115 A 3/1978 Sims et al.
4,646,856 A * 3/1987 Dismukes ..... E21B 4/02 175/107
6,142,245 A 11/2000 Best
6,296,066 B1 10/2001 Terry et al.
(Continued)

FOREIGN PATENT DOCUMENTS

CN 1281845 C 10/2006
CN 1888372 A 1/2007
(Continued)

OTHER PUBLICATIONS

Written Opinion dated Dec. 10, 2012, issued in corresponding PCT application No. PCT/US2012/034174, filed Apr. 19, 2012, 5pgs.

*Primary Examiner* — Caroline Butcher
(74) *Attorney, Agent, or Firm* — Chamberlain Hrdlicka

(57) ABSTRACT

Drill string assemblies, bottom hole assemblies (BHAs), and powertrains for a BHA in a drill string are presented herein. A BHA for use in a drill string to drill boreholes in an earth formation is disclosed. The BHA includes a housing, a drill bit rotatably coupled to the housing, and a fluidly driven motor assembly, such as a positive displacement motor (PDM). The PDM assembly includes a drive shaft to output rotational drive forces generated by the PDM. Also included is a differential gear set with a first gear member coupled to the drive shaft, a second gear member intermeshing the first gear member with the housing, and a third gear member couple to the drill bit. The differential gear set transmits the rotational drive forces from the drive shaft to the drill bit and rotates the drill bit at a speed greater than the speed of the PDM assembly.

20 Claims, 3 Drawing Sheets

(56) References Cited

U.S. PATENT DOCUMENTS

| | | | | |
|---|---|---|---|---|
| 6,761,574 | B1 | 7/2004 | Song et al. | |
| 6,863,137 | B2 | 3/2005 | Terry et al. | |
| 7,287,609 | B2 | 10/2007 | Runia et al. | |
| 7,594,541 | B2 | 9/2009 | Ciglenec et al. | |
| 8,967,253 | B2 | 3/2015 | Ciglenec et al. | |
| 9,121,262 | B2 | 9/2015 | Ciglenec et al. | |
| 2002/0007970 | A1 | 1/2002 | Terry et al. | |
| 2003/0008748 | A1 | 1/2003 | Fox | |
| 2004/0026129 | A1* | 2/2004 | Downie | E21B 4/006 175/106 |
| 2004/0118611 | A1 | 6/2004 | Runia et al. | |
| 2008/0099247 | A1 | 5/2008 | Andoskin et al. | |
| 2008/0156486 | A1 | 7/2008 | Ciglenec et al. | |
| 2010/0175925 | A1 | 7/2010 | Ciglenec et al. | |
| 2010/0259415 | A1 | 10/2010 | Strachan | |
| 2011/0129375 | A1 | 6/2011 | Kotsonis | |
| 2011/0146998 | A1 | 6/2011 | Tunget | |
| 2013/0277116 | A1* | 10/2013 | Knull | E21B 4/003 175/57 |

FOREIGN PATENT DOCUMENTS

| | | | |
|---|---|---|---|
| CN | 101027456 | A | 8/2007 |
| CN | 101210546 | A | 7/2008 |

* cited by examiner

DRILLING ASSEMBLY WITH HIGH-SPEED MOTOR GEAR SYSTEM

CROSS-REFERENCE AND CLAIM OF PRIORITY TO RELATED APPLICATION

This application is a U.S. National Phase of International Application No. PCT/US2012/034174, which was filed on Apr. 19, 2012, and is incorporated herein by reference in its entirety and for all purposes.

TECHNICAL FIELD

The present disclosure relates generally to the drilling of boreholes, for example, during hydrocarbon exploration and excavation. More particularly, the present disclosure relates to drilling assemblies with high-speed fluid-driven motors used in drilling boreholes.

BACKGROUND

Boreholes, which are also commonly referred to as "wellbores" and "drill holes," are created for a variety of purposes, including exploratory drilling for locating underground deposits of different natural resources, mining operations for extracting such deposits, and construction projects for installing underground utilities. A common misconception is that all boreholes are vertically aligned with the drilling rig; however, many applications require the drilling of boreholes with vertically deviated and horizontal geometries. A well-known technique employed for drilling horizontal, vertically deviated, and other complex boreholes is directional drilling. Directional drilling is generally typified as a process of boring a hole which is characterized in that at least a portion of the course of the bore hole in the earth is in a direction other than strictly vertical—i.e., the axes make an angle with a vertical plane (known as "vertical deviation"), and are directed in an azimuth plane.

Conventional directional boring techniques traditionally operate from a boring device that pushes or steers a series of connected drill pipes with a directable drill bit at the distal end thereof to achieve the borehole geometry. In the exploration and recovery of subsurface hydrocarbon deposits, such as petroleum and natural gas, the directional borehole is typically drilled with a rotatable drill bit that is attached to one end of a bottom hole assembly or "BHA." A steerable BHA can include, for example, a positive displacement motor (PDM) or "mud motor," drill collars, reamers, shocks, and underreaming tools to enlarge the wellbore. A stabilizer may be attached to the BHA to control the bending of the BHA to direct the bit in the desired direction (inclination and azimuth). The BHA, in turn, is attached to the bottom of a tubing assembly, often comprising jointed pipe or relatively flexible "spoolable" tubing, also known as "coiled tubing." This directional drilling system—i.e., the operatively interconnected tubing, drill bit and BHA—is usually referred to as a "drill string." When jointed pipe is utilized in the drill string, the drill bit can be rotated by rotating the jointed pipe from the surface, through the operation of the mud motor contained in the BHA, or both. In contrast, drill strings which employ coiled tubing generally rotate the drill bit via the mud motor in the BHA.

Many conventional drilling motors include a progressive cavity, positive displacement motor (PDM) to provide additional power to the bit during a drilling operation. As an alternative to PDMs, some BHAs will employ a turbine-based motor (or "turbodrill") to provide the additional power. Both PDM and turbine motors are fluidly driven by the drilling mud pumped down the drill string, through the drilling motor, and out the bit assembly. After exiting the distal end of the drill string through ports in the drill bit, the drilling fluid operates, in part, to carry drill cuttings from the drill bit to the surface up through the annulus between the drill string and the wall of the borehole. Conventional PDMs typically operate at a slow rotational velocity with a high torque output; contrastingly, turbines typically operate at high rotational velocities with a low output torque.

Historically, it was desired to carry out drilling operations in a low speed, high torque operation to reduce the likelihood of the drill bit sticking in the formation and, thus, the likelihood of damage to the BHA in the event that the drill bit does become stuck. For this reason, PDMs, which typically operate at slow speeds and generate high torque, tend to be the predominant workhorse in borehole drilling. PDMs, however, include some components that can be damaged under the high pressures and temperatures experienced during a drilling operation. Damage to these components can lead to failure of the PDM which, in turn, requires costly, time-consuming replacement. To reduce downtime and repair costs, it is sometimes preferred to use turbine-based drilling motors which do not normally include such easily damaged components. However, as noted above, turbines are high speed, low output torque motors; thus, it is often required to provide a speed-reduction mechanism to reduce the rotational velocity of the turbine.

Some drilling operations now require a high-speed, high-torque output mud motor. With recent developments in drilling technology, including improvements in lubrication capabilities and the availability of high-performance drill bits, a number of complex-bore drilling operations can be performed at high rotational velocities and with high torque. Other operations which can benefit from a high-speed, high torque output motor include, for example, drilling vertical boreholes, drilling in soft formations, and directional applications where single-shot orientations are being used. However, conventional PDM assemblies and turbine-driven mud motors do not provide both high-speed and high-torque output functionality.

SUMMARY

Aspects of this disclosure are directed to high-speed high-torque downhole drilling motor configurations (e.g., 1,000-1250 RPM; 9,000-12,000 ft-lb). Some of these concepts employ a planetary gear train between a high-torque positive displacement motor (PDM) and the drill bit to amplify RPM and transmit more torque to the bit. Exemplary configurations include a drive shaft from the downhole mud motor driving a planetary-gear carrier, and output from the gear train is by way of a sun gear attached to or integral with a bit sub. A ring gear, which could be the reaction member, can be attached to or integrated with a motor housing. The bearings and gear train can be lubricated via the drilling mud through a bypass system. This concept could also be constructed as a modular assembly that can be added to existing mud motors.

According to aspects of the present disclosure, a bottom hole assembly (BHA) is presented for use in a drill string to drill a borehole in an earth formation. The BHA includes a housing with a drill bit rotatably coupled to the housing. The BHA also includes a fluidly driven motor assembly and a differential gear set. The fluidly driven motor assembly has a drive shaft configured to output rotational drive forces generated by the motor assembly at a first speed. The differential gear set has a first gear member that is mechanically coupled to the drive shaft of the fluidly driven motor assembly, a second gear member that intermeshes the first gear member with the housing, and a third gear member that is mechanically coupled to the drill bit. The differential gear set transmits the rotational drive forces from the drive shaft to the drill bit and rotates the drill bit at a second speed that is greater than the first speed.

Other aspects of the present disclosure are directed to a powertrain for a bottom hole assembly (BHA) in a drill string with a drill pipe and a drill bit. The powertrain includes a positive displacement motor (PDM) assembly and a differential gear set. The PDM assembly includes a motor housing configured to operatively connect to the drill pipe in the drill string and receive drilling fluid therefrom. The PDM assembly also includes a multi-lobed stator defining an internal passage, and a multi-lobed rotor disposed within the stator. A drive shaft is coupled to the rotor and configured to output rotational drive forces generated by the PDM assembly at a first speed. The differential gear set includes three gear members: a first gear member is mechanically coupled to the drive shaft of the PDM assembly, a second gear member intermeshes the first gear member with the motor housing, and a third gear member is mechanically coupled to the drill bit. The differential gear set transmits the rotational drive forces from the drive shaft to the drill bit and rotates the drill bit at a second speed that is greater than the first speed.

A drill string system is featured in accordance with other aspects of this disclosure. The drill string includes a drill-pipe string with a tubular housing operatively attached to a distal end of the drill-pipe string. The tubular housing defines a housing bore. A drill bit is rotatably coupled to the tubular housing. An output shaft extends out of the tubular housing. The output shaft includes a bit sub that is coupled to the drill bit. Axial and radial bearing assemblies are disposed inside the housing bore between the housing and the output shaft and operatively connecting the same. A fluid-driven positive displacement motor (PDM) assembly is disposed at least partially within the housing bore. The PDM assembly includes a stator, a rotor rotatable within the stator, and a drive shaft coupled to the rotor and configured to output rotational drive forces generated by the PDM assembly at a first speed. The system also includes a planetary gear system with a planet carrier, a ring gear, and a sun gear. The planet carrier is directly coupled to the drive shaft of the PDM assembly. The ring gear is directly coupled to the tubular housing and intermeshes with planetary gears of the planet carrier. The sun gear is directly coupled to the output shaft and intermeshes with planetary gears of the planet carrier. The planetary gear system transmits the rotational drive forces from the drive shaft of the PDM assembly to the drill bit and rotates the drill bit at a second speed greater than the first speed.

The above summary is not intended to represent each embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of the exemplary embodiments and modes for carrying out the present invention when taken in connection with the accompanying drawings and appended claims.

Figure 1:
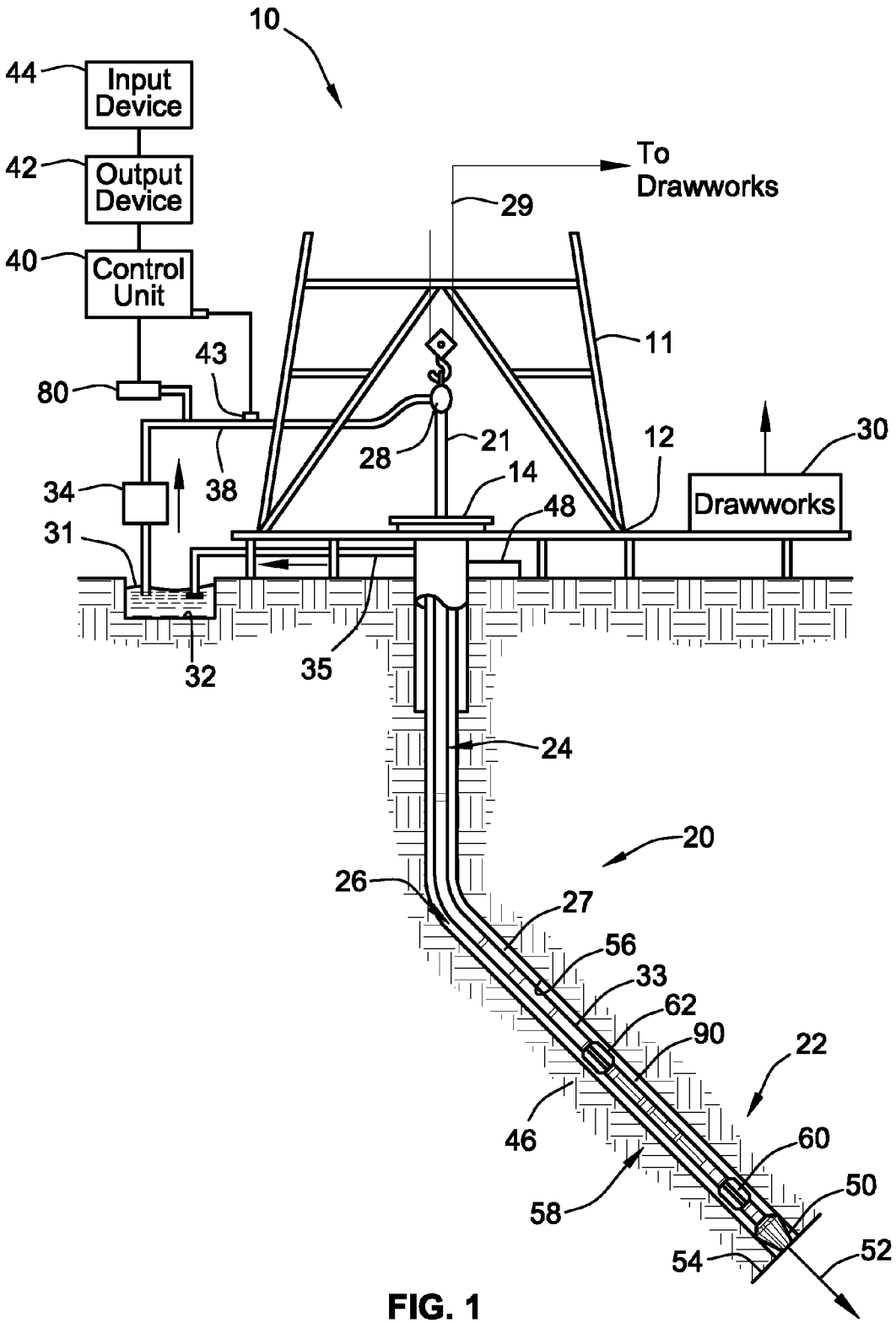
FIG. 1 is a schematic illustration of an exemplary drilling system in accordance with aspects of the present disclosure.

While the present disclosure is susceptible to various modifications and alternative forms, specific embodiments have been shown by way of example in the drawings and will be described in detail herein. It should be understood, however, that the disclosure is not intended to be limited to the particular forms disclosed. Rather, the disclosure is to cover all modifications, equivalents, and alternatives falling within the spirit and scope of the invention as defined by the appended claims.

DETAILED DESCRIPTION OF THE ILLUSTRATED EMBODIMENTS

While this invention is susceptible of embodiment in many different forms, there are shown in the drawings and will herein be described in detail embodiments of the invention with the understanding that the present disclosure is to be considered as an exemplification of the principles of the invention and is not intended to limit the broad aspects of the invention to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed, the singular includes the plural and vice versa; the words "and" and "or" shall be both conjunctive and disjunctive; the word "all" means "any and all"; the word "any" means "any and all"; and the word "including" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example.

Referring now to the drawings, wherein like reference numerals refer to like components throughout the several views, FIG. 1 illustrates an exemplary directional drilling system, designated generally as 10, in accordance with aspects of the present disclosure. Many of the disclosed concepts are discussed with reference to drilling operations for the exploration and/or recovery of subsurface hydrocarbon deposits, such as petroleum and natural gas. However, the disclosed concepts are not so limited, and can be applied to other drilling operations. To that end, the aspects of the present disclosure are not necessarily limited to the arrangement and components presented in FIGS. 1 and 2. For example, many of the features and aspects presented herein can be applied in horizontal drilling applications and vertical drilling applications without departing from the intended scope and spirit of the present disclosure. In addition, it should be understood that the drawings are not necessarily to scale and are provided purely for descriptive purposes; thus, the individual and relative dimensions and orientations presented in the drawings are not to be considered limiting. Additional information relating to directional drilling systems can be found, for example, in U.S. Patent Application Publication No. 2010/0259415 A1, to Michael Strachan et al., which is entitled "Method and System for Predicting Performance of a Drilling System Having Multiple Cutting Structures" and is incorporated herein by reference in its entirety for all purposes.

The directional drilling system 10 exemplified in FIG. 1 includes a tower or "derrick" 11, as it is most commonly referred to in the art, that is buttressed by a derrick floor 12. The derrick floor 12 supports a rotary table 14 that is driven at a desired rotational speed, for example, via a chain drive system through operation of a prime mover (not shown). The rotary table 14, in turn, provides the necessary rotational force to a drill string 20. The drill string 20, which includes a drill pipe section 24, extends downwardly from the rotary table 14 into a directional borehole 26. As illustrated in the Figures, the borehole 26 may travel along a multi-dimensional path or "trajectory." The three-dimensional direction of the bottom 54 of the borehole 26 of FIG. 1 is represented by a pointing vector 52.

A drill bit 50 is attached to the distal, downhole end of the drill string 20. When rotated, e.g., via the rotary table 14, the drill bit 50 operates to break up and generally disintegrate the geological formation 46. The drill string 20 is coupled to a "drawworks" hoisting apparatus 30, for example, via a kelly joint 21, swivel 28, and line 29 through a pulley system (not shown). The drawworks 30 may comprise various components, including a drum, one or more motors, a reduction gear, a main brake, and an auxiliary brake. During a drilling operation, the drawworks 30 can be operated, in some embodiments, to control the weight on bit 50 and the rate of penetration of the drill string 20 into the borehole 26. The operation of drawworks 30 is generally known and is thus not described in detail herein.

During drilling operations, a suitable drilling fluid (commonly referred to in the art as "mud") 31 can be circulated, under pressure, out from a mud pit 32 and into the borehole 26 through the drill string 20 by a hydraulic "mud pump" 34. The drilling fluid 31 may comprise, for example, water-based muds (WBM), which typically comprise a water-and-clay based composition, oil-based muds (OBM), where the base fluid is a petroleum product, such as diesel fuel, synthetic-based muds (SBM), where the base fluid is a synthetic oil, as well as gaseous drilling fluids. Drilling fluid 31 passes from the mud pump 34 into the drill string 20 via a fluid conduit (commonly referred to as a "mud line") 38 and the kelly joint 21. Drilling fluid 31 is discharged at the borehole bottom 54 through an opening or nozzle in the drill bit 50, and circulates in an "uphole" direction towards the surface through an annular space 27 between the drill string 20 and the side of the borehole 26. As the drilling fluid 31 approaches the rotary table 14, it is discharged via a return line 35 into the mud pit 32. A variety of surface sensors 48, which are appropriately deployed on the surface of the borehole 26, operate alone or in conjunction with downhole sensors 70, 72 deployed within the borehole 26, to provide information about various drilling-related parameters, such as fluid flow rate, weight on bit, hook load, etc., which will be explained in further detail below.

A surface control unit 40 may receive signals from surface and downhole sensors and devices via a sensor or transducer 43, which can be placed on the fluid line 38. The surface control unit 40 can be operable to process such signals according to programmed instructions provided to surface control unit 40. Surface control unit 40 may present to an operator desired drilling parameters and other information via one or more output devices 42, such as a display, a computer monitor, speakers, lights, etc., which may be used by the operator to control the drilling operations. Surface control unit 40 may contain a computer, memory for storing data, a data recorder, and other known and hereinafter developed peripherals. Surface control unit 40 may also include models and may process data according to programmed instructions, and respond to user commands entered through a suitable input device 44, which may be in the nature of a keyboard, touchscreen, microphone, mouse, joystick, etc.

In some embodiments of the present disclosure, the rotatable drill bit 50 is attached at a distal end of a steerable drilling bottom hole assembly (BHA) 22. In the illustrated embodiment, the BHA 22 is coupled between the drill bit 50 and the drill pipe section 24 of the drill string 20. The BHA 22 may comprise a Measurement While Drilling (MWD) System, designated generally at 58 in FIG. 1, with various sensors to provide information about the formation 46 and downhole drilling parameters. The MWD sensors in the BHA 22 may include, but are not limited to, a device for measuring the formation resistivity near the drill bit, a gamma ray device for measuring the formation gamma ray intensity, devices for determining the inclination and azimuth of the drill string, and pressure sensors for measuring drilling fluid pressure downhole. The MWD may also include additional/alternative sensing devices for measuring shock, vibration, torque, telemetry, etc. The above-noted devices may transmit data to a downhole transmitter 33, which in turn transmits the data uphole to the surface control unit 40. In some embodiments, the BHA 22 may also include a Logging While Drilling (LWD) System.

In some embodiments, a mud pulse telemetry technique may be used to communicate data from downhole sensors and devices during drilling operations. Exemplary methods and apparatuses for mud pulse telemetry are described in U.S. Pat. No. 7,106,210 B2, to Christopher A. Golla et al., which is incorporated herein by reference in its entirety. Other known methods of telemetry which may be used without departing from the intended scope of this disclosure include electromagnetic telemetry, acoustic telemetry, and wired drill pipe telemetry, among others.

A transducer 43 can be placed in the mud supply line 38 to detect the mud pulses responsive to the data transmitted by the downhole transmitter 33. The transducer 43 in turn generates electrical signals, for example, in response to the mud pressure variations and transmits such signals to the surface control unit 40. Alternatively, other telemetry techniques such as electromagnetic and/or acoustic techniques or any other suitable techniques known or hereinafter developed may be utilized. By way of example, hard wired drill pipe may be used to communicate between the surface and downhole devices. In another example, combinations of the techniques described may be used. As illustrated in FIG. 1, a surface transmitter receiver 80 communicates with downhole tools using, for example, any of the transmission techniques described, such as a mud pulse telemetry technique. This can enable two-way communication between the surface control unit 40 and the downhole tools described below.

According to aspects of this disclosure, the BHA 22 can provide some or all of the requisite force for the bit 50 to break through the formation 46 (known as "weight on bit"), and provide the necessary directional control for drilling the borehole 26. In the embodiments illustrated in FIGS. 1 and 2, the BHA 22 may comprise a drilling motor 90 and first and second longitudinally spaced stabilizers 60 and 62. At least one of the stabilizers 60, 62 may be an adjustable stabilizer that is operable to assist in controlling the direction of the borehole 26. Optional radially adjustable stabilizers may be used in the BHA 22 of the steerable directional drilling system 10 to adjust the angle of the BHA 22 with respect to the axis of the borehole 26. A radially adjustable stabilizer provides a wider range of directional adjustability than is available with a conventional fixed diameter stabilizer. This adjustability may save substantial rig time by allowing the BHA 22 to be adjusted downhole instead of tripping out for changes. However, even a radially adjustable stabilizer provides only a limited range of directional adjustments. Additional information regarding adjustable stabilizers and their use in directional drilling systems can be found in U.S. Patent Application Publication No. 2011/0031023 A1, to Clive D. Menezes et al., which is entitled "Borehole Drilling Apparatus, Systems, and Methods" and is incorporated herein by reference in its entirety.

Figure 2:
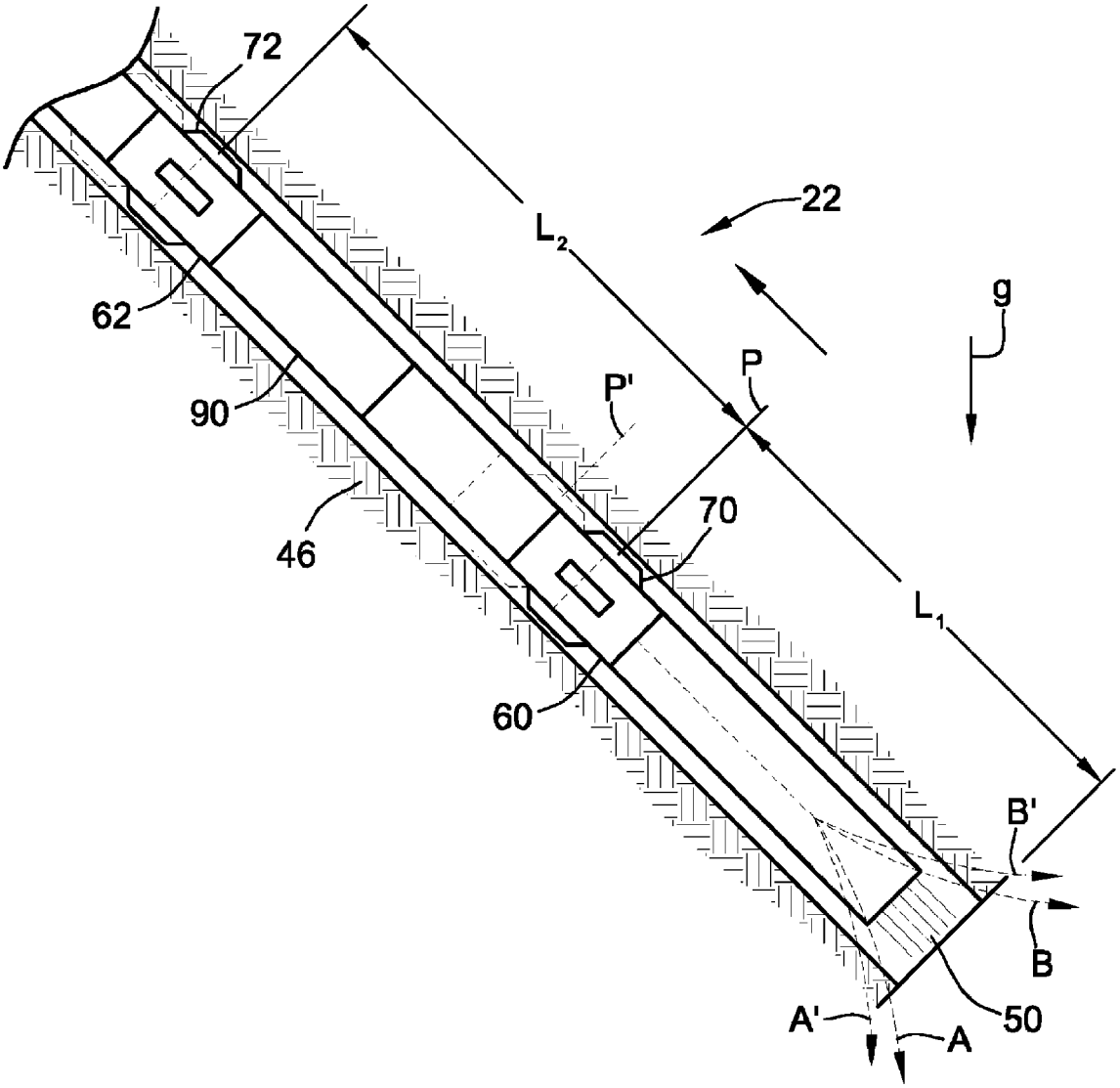
FIG. 2 is a schematic illustration of an exemplary bottom hole assembly (BHA) in accordance with aspects of the present disclosure.

As shown in the embodiment of FIG. 2, the distance between the drill bit 50 and the first stabilizer 60, designated as $L_1$, can be a factor in determining the bend characteristics of the BHA 22. Similarly, the distance between the first stabilizer 60 and the second stabilizer 62, designated as $L_2$, can be another factor in determining the bend characteristics of the BHA 22. The deflection at the drill bit 50 of the BHA 22 is a nonlinear function of the distance $L_1$, such that relatively small changes in $L_1$ may significantly alter the bending characteristics of the BHA 22. With radially movable stabilizer blades, a dropping or building angle, for example A or B, can be induced at bit 50 with the stabilizer at position P. By axially moving stabilizer 60 from P to P', the deflection at bit 50 can be increased from A to A' or B to B'. A stabilizer having both axial and radial adjustment may substantially extend the range of directional adjustment, thereby saving the time necessary to change out the BHA 22 to a different configuration. In some embodiments the stabilizer may be axially movable. The position and adjustment of the second stabilizer 62 adds additional flexibility in adjusting the BHA 22 to achieve the desired bend of the BHA 22 to achieve the desired borehole curvature and direction. As such, the second stabilizer 62 may have the same functionality as the first stabilizer 60. While shown in two dimensions, proper adjustment of stabilizer blades may also provide three dimensional turning of BHA 22.

Figure 3:
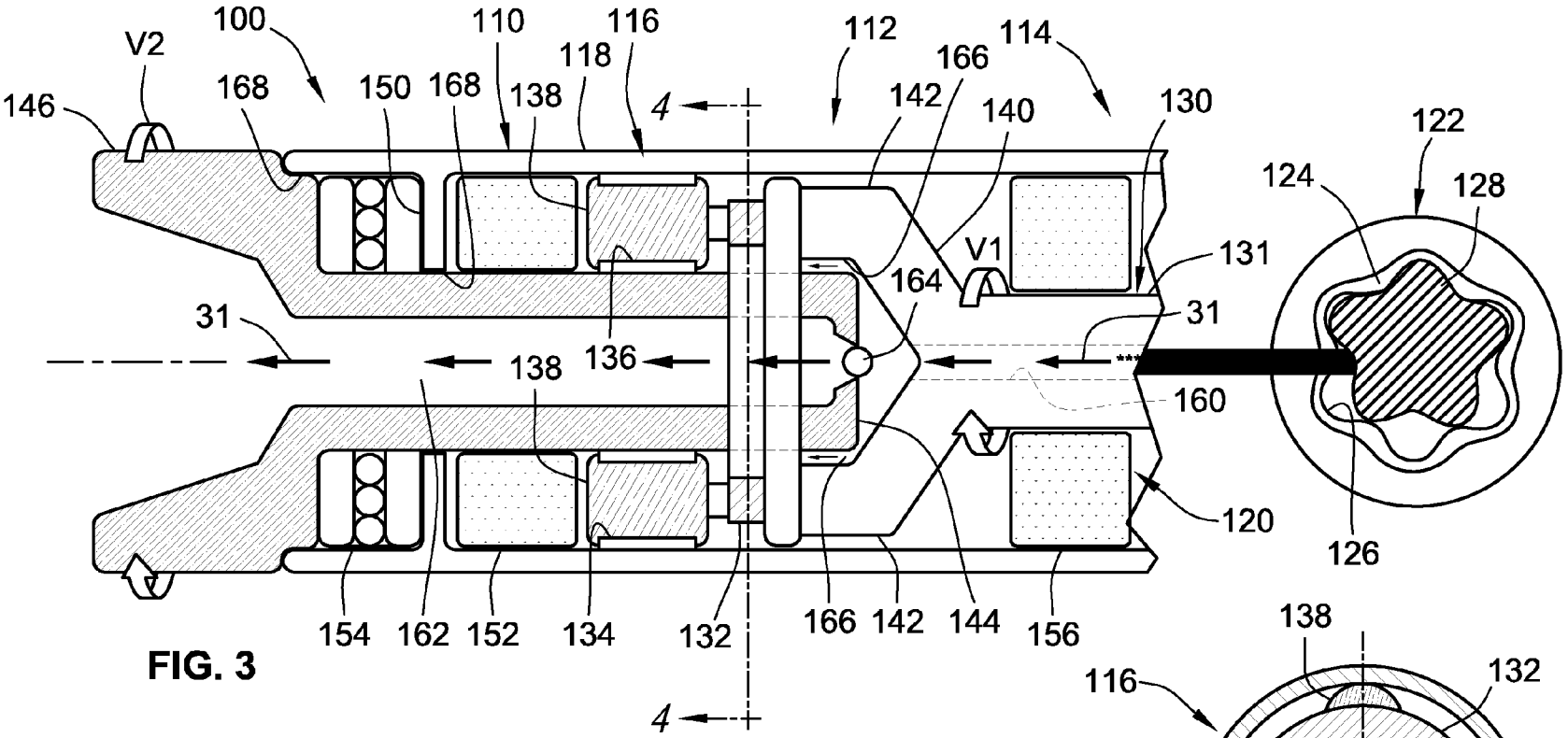
FIG. 3 is a diagrammatic cross-sectional illustration of a representative fluid-driven motor and planetary gear system in accordance with aspects of the present disclosure.

FIG. 3 illustrates a portion of a drill string system 100 of the type used for drilling a borehole in an earth formation. The drill string system 100 of FIG. 3 is represented by a bottom hole assembly (BHA) 110, which is shown in cross-section to more clearly depict an internally packaged powertrain assembly, designated generally at 112. The drill string system 100 of FIG. 3 can take on any of the various forms, optional configurations, and functional alternatives described above with respect to the directional drilling system 10 exemplified in FIGS. 1 and 2, and thus can include any of the corresponding options and features. Moreover, only selected components of the drill string system 100 have been shown and will be described in additional detail hereinbelow. Nevertheless, the drill string systems discussed hereinbelow, including the corresponding BHA and powertrain configurations, can include numerous additional, alternative, and other well-known peripheral components without departing from the scope and spirit of the present disclosure. Seeing as these components are well known in the art, they will not be described in further detail.

The powertrain 112 includes a fluid-driven motor assembly 114 and a differential gear set 116, both of which are shown disposed at least partially inside an internal housing bore 120 of an elongated, tubular housing 118. For some optional configurations, the motor assembly 114 and differential gear set 116 could be packaged separately—e.g., the differential gear set 116 could be constructed as a modular assembly that can be retrofit to the BHA 110. The tubular housing 118 is operatively attached, e.g., via a top sub (not shown), to the distal end of a drill pipe or drill-pipe string, such as the drill pipe section 24 in FIG. 1, to receive drilling fluid therefrom. In the illustrated embodiment, the fluid-driven motor assembly 114 is a positive displacement motor (PDM) assembly, which may be in the nature of SperryDrill® or SperryDrill® XL/XLS series positive displacement motor assemblies available from Halliburton of Houston, Tex. In this instance, the housing 118 may be a portion of a motor housing which is attached to the top sub via power section 122. The PDM assembly 114 includes a multi-lobed stator 124 with an internal passage 126 within which is disposed a multi-lobed rotor 128. The PDM assembly 114 operates according to the Moineau principle—essentially, when pressurized fluid is forced into the PDM assembly 114 and through the series of helically shaped channels formed between the stator 124 and rotor 128, the pressurized fluid acts against the rotor 128 causing nutation and rotation of the rotor 128 within the stator 124. Rotation of the rotor 128 generates a rotational drive force for the drill bit, as will be developed in further detail below.

The distal end of the rotor 128 is indirectly coupled to a rotatable drill bit (e.g., drill bit 50 of FIG. 1) via the differential gear set 116, where the eccentric power from the rotor 128 is transmitted as concentric power to the bit. According to the illustrated embodiment, a drive shaft 130 is operatively coupled to the rotor 128 and configured to output the rotational drive forces generated by the PDM assembly 114 at a first speed V1. In this manner, the PDM assembly 114 can provide a drive mechanism for the drill bit which is at least partially and, in some instances, completely independent of any rotational motion of the drill string generated, for example, via rotation of the rotary table 14 on the derrick floor 12 of FIG. 1. Directional drilling may also be performed by rotating the drill string 100 while contemporaneously powering the PDM assembly 114, thereby increasing the available torque and drill bit speed. The drill bit may take on various forms, including diamond-impregnated bits and specialized polycrystalline-diamond-compact (PDC) bit designs, such as the FX and FS Series™ drill bits available from Halliburton of Houston, Tex.

Figure 4:
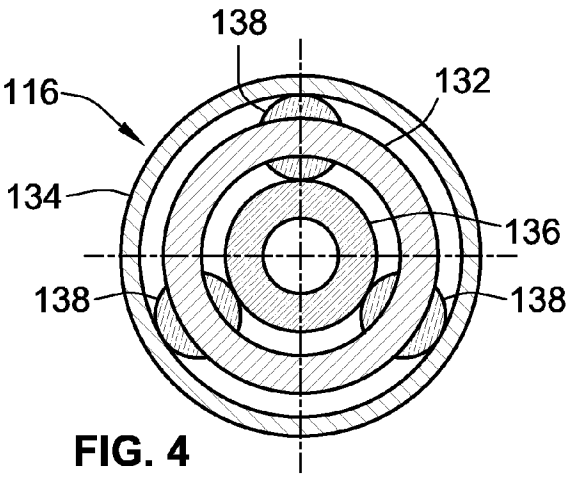
FIG. 4 is a cross-sectional illustration of the planetary gear system of FIG. 3 taken along line 4-4.

The differential gear set 116 is adapted to manipulate and distribute power from the PDM assembly 114 to the drill bit, as will be explained in further detail below. In the embodiment of FIG. 3, the differential gear set 116 is an epicyclic gear arrangement, most commonly referred to as a planetary gear system. The differential gear set 116 has three primary gear members: a first gear member 132 that is mechanically coupled to the drive shaft 130 of the PDM assembly 114; a second gear member 134 that intermeshes the first gear member 132 with the housing 118; and a third gear member 136 that is mechanically coupled to the drill bit, e.g., via a bit sub 146 (also known as a "bottom sub"). As seen in FIG. 4, the first gear member 132 is a planet carrier assembly, the second gear member 134 is an annular ring gear, and the third gear member 136 is an annular sun gear. The ring gear 134 circumscribes and is coaxially aligned with both the sun gear 136 and the planet carrier assembly 132. Included with the planet carrier assembly 132 is a plurality of planetary gears 138 (also referred to in the art as "pinion gears") rotatably mounted on the planet carrier assembly 132; each planetary gear 138 is meshingly engaged with both the ring gear 134 and the sun gear 136. Although shown as a simple planetary gear set, it is also envisioned that the differential gear set 116 comprise a meshed, stepped, or multi-staged compound arrangement.

In the illustrated embodiment, the planet carrier 132 is continuously coupled directly to the drive shaft 130 of the PDM assembly 114. By way of non-limiting example, the distal end of the drive shaft 130 includes a crows-foot yoke 140 with a plurality of circumferentially spaced toes 142. The crows-foot yoke 140 operates to mechanically couple the planet carrier 132 to the drive shaft 130 for common rotation therewith. When the drive shaft 130 is spinning, the yoke 140 also generates an annular pocket within which is nested the proximal end of an elongated output shaft 144. The ring gear 134 is continuously coupled (e.g., splined) directly to the housing 116. Optionally, the ring gear may be machined into or otherwise integrally formed with the housing 116. In a similar regard, the sun gear 136 is continuously coupled to the drill bit. As shown, the sun gear 136 is attached (e.g., splined) directly to the output shaft 144, which in turn extends out of the housing 118 and couples directly to the drill bit via bit sub 146. The sun gear 136 can be machined into or otherwise integrally formed with the output shaft 144.

The arrangement of gears 132, 134, 136, 138 in the epicyclic train 116 of FIG. 3 permits the rotation of the input and output shafts 130, 144 at different speeds. Continuing with the illustrated gear system, the ring gear 134, which is held relatively stationary, operates as the system's reaction member, while the planet carrier 132 operates as the system's input or "driven" member, receiving power for the system, and the sun gear 136 operates as the system's output or "driving" member, transferring power from the system. From the drive shaft 130, the differential gear set 116 transmits the rotational drive forces generated by the PDM assembly 114 to the drill bit, and rotates the drill bit at a second rotational speed V2 that is greater than the first rotational speed V1. In comparison to its conventional counterparts, this powertrain configuration provides for higher torque output at high speeds by amplifying the rotational velocity of a high torque output PDM assembly.

The BHA 110 of FIG. 3 also includes a bearing assembly which protects the powertrain 112 from on- and off-bottom loading conditions. Proximal to the distal end of the housing 118 is an annular flange 150 which extends radially inward into the housing bore 120 and circumscribes the output shaft 144. A high-speed radial bearing assembly 152 is disposed inside the housing bore 120 radially intermediate the housing 118 and the output shaft 144. The radial bearing assembly 152 is also disposed in-between the annular flange 150 and the differential gear set 116. The radial bearing assembly 152 operates to reduce rotational friction and support radial loads. An axial bearing assembly 154 is also disposed inside the housing bore 120 radially intermediate the housing 118 and the output shaft 144, but on the opposite side of the annular flange 150 from the axial bearing assembly 152, separating the annular flange 150 from the bit sub 146 and, thus, the drill bit. The axial bearing assembly 154 operates to reduce rotational friction and support axial loads. A low-speed radial bearing assembly 156 is disposed inside the housing bore 120, upstream from the differential gear set 116, radially intermediate the housing 118 and the drive shaft 130.

With continuing reference to FIGS. 3 and 4, an elongated tubular section 131 of the drive shaft 130 includes a (first) fluid passage, shown hidden in FIG. 3 at 160, which extends longitudinally through the center of the tubular section 131. The fluid passage 160 allows pressurized drilling fluid 31 to pass from the PDM assembly 114, through the center of the drive shaft 130, into the differential gear set 116 and the output shaft 144. The output shaft 144, which couples the drill bit to the differential gear set 116, includes a (second) fluid passage 162 that extends longitudinally through the center of the output shaft 144. This fluid passage 162 is fluidly connected to the fluid passage 160 of the drive shaft 130 to allow drilling fluid 31 to pass from the drive shaft 130, through the center of the output shaft 144, out through the bit sub 146 and into the drill bit. A flow restriction device 164 (e.g., an orifice, a poppet valve, ball valve, solenoid valve, etc.) is disposed between the first and second fluid passages 160, 162. The flow restriction device 164 is designed to regulate the flow of drilling fluid 31 from the first fluid passage 160 to the second fluid passage 162, for example, to ensure gear and bearing lubrication bypass flow. In this regard, the BHA 110 may be provided with one or more fluid bypass passages 166 which redirect drilling fluid 31 expelled from the first fluid passage 160 away from the second fluid passage 162 and into the differential gear set 116. Lube bypass passages 168 allow drilling fluid 31, which passed from the fluid passage 160 and through the differential gear set 116 and bearing assemblies 152, 154, to exit the housing 118 proximal the bit sub 146.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

What is claimed is:

1. A bottom hole assembly (BHA) for use in a drill string with a drill bit to drill a borehole in an earth formation, the BHA comprising:

a housing;

a fluidly driven motor assembly with a drive shaft configured to output rotational drive forces generated by the fluidly driven motor assembly at a first speed;

a differential gear set comprising a first gear member mechanically coupled to the drive shaft of the fluidly driven motor assembly, a second gear member intermeshing the first gear member with the housing, and a third gear member mechanically coupled to the drill bit, the differential gear set being operable to transmit the rotational drive forces from the drive shaft to the drill bit and rotate the drill bit at a second speed greater than the first speed;

a first fluid passage operable to pass drilling fluid from the fluidly driven motor assembly and into the differential gear set;

a second fluid passage operable to pass drilling fluid from the drive shaft and into the drill bit; and a fluid bypass passage operable to redirect drilling fluid from the first fluid passage and into the differential gear set.

2. The BHA of claim 1, wherein the differential gear set is a planetary gear system, the first gear member is a planet carrier, the second gear member is a ring gear, and the third gear member is a sun gear.

3. The BHA of claim 2, wherein the planet carrier is continuously coupled directly to the drive shaft of the fluidly driven motor.

4. The BHA of claim 2, wherein the ring gear is continuously coupled directly to the housing.

5. The BHA of claim 4, wherein the ring gear is integrally formed with the housing.

6. The BHA of claim 2, wherein the sun gear is continuously coupled to the drill bit.

7. The BHA of claim 2, further comprising an output shaft extending out of the housing and coupled to the drill bit, the sun gear being continuously coupled directly to the output shaft.

8. The BHA of claim 7, wherein the sun gear is integrally formed with the output shaft.

9. The BHA of claim 1, wherein the fluidly driven motor assembly is a positive displacement motor.

10. The BHA of claim 1, wherein the drive shaft of the fluidly driven motor assembly includes an elongated tubular section comprising the first fluid passage extending longitudinally through the elongated tubular section, the first fluid passage being configured to allow drilling fluid to pass through the drive shaft.

11. The BHA of claim 10, further comprising an elongated output shaft coupling the drill bit to the differential gear set and including the second fluid passage extending longitudinally through the output shaft, the second fluid passage being fluidly connected to the first fluid passage and configured to allow drilling fluid to pass from the drive shaft, through the output shaft, and into the drill bit.

12. The BHA of claim 11, further comprising a flow restriction device disposed between the first and second fluid passages and configured to regulate the flow of drilling fluid from the first fluid passage to the second fluid passage.

13. The BHA of claim 11, wherein the fluid bypass passage redirects drilling fluid from the first fluid passage, away from the second fluid passage, and into the differential gear set.

14. The BHA of claim 1, wherein the drive shaft includes a yoke at a distal end thereof, the yoke mechanically coupling the first gear member to the drive shaft.

15. A powertrain for a bottom hole assembly (BHA) in a drill string with a drill pipe and a drill bit, the powertrain comprising:

a positive displacement motor (PDM) assembly including:

a motor housing configured to operatively connect to the drill pipe in the drill string and receive drilling fluid therefrom, a multi-lobed stator defining an internal passage, a multi-lobed rotor disposed within the stator, and a drive shaft coupled to the rotor and configured to output rotational drive forces generated by the PDM assembly at a first speed;

a differential gear set including:

a first gear member mechanically coupled to the drive shaft of the PDM assembly, a second gear member intermeshing the first gear member with the motor housing, and a third gear member mechanically coupled to the drill bit;

a fluid bypass passage operable to redirect drilling fluid from a first fluid passage, away from a second fluid passage, and into the differential gear set; and wherein the differential gear set is operable to transmit the rotational drive forces from the drive shaft to the drill bit and rotate the drill bit at a second speed greater than the first speed.

16. The powertrain of claim 15, wherein the differential gear set is a planetary gear system, the first gear member is a planet carrier, the second gear member is a ring gear, and the third gear member is a sun gear.

17. The powertrain of claim 16, wherein the planet carrier is continuously coupled directly to the drive shaft of the PDM assembly.

18. The powertrain of claim 17, wherein the ring gear is continuously coupled directly to the housing.

19. The powertrain of claim 18, wherein the sun gear is continuously coupled to the drill bit.

20. A drill string system comprising:

a drill string;

a tubular housing operatively attached to a distal end of the drill string, the tubular housing defining a housing bore;

a drill bit rotatably coupled to the tubular housing;

an output shaft extending out of the tubular housing, the output shaft including a bit sub coupled to the drill bit;

axial and radial bearing assemblies disposed inside the housing bore between and operatively connecting the housing and the output shaft;

a fluid-driven positive displacement motor (PDM) assembly disposed at least partially within the housing bore, the PDM assembly including a stator, a rotor rotatable within the stator, and a drive shaft coupled to the rotor and configured to output rotational drive forces generated by the PDM assembly at a first speed;

a planetary gear system with a planet carrier, a ring gear, and a sun gear, the planet carrier being directly coupled to the drive shaft of the PDM assembly, the ring gear being directly coupled to the tubular housing and intermeshing with planetary gears of the planet carrier, and the sun gear being directly coupled to the output shaft and intermeshing with planetary gears of the planet carrier, wherein the planetary gear system transmits the rotational drive forces from the drive shaft to the drill bit and rotates the drill bit at a second speed greater than the first speed; and a fluid bypass passage operable to redirect drilling fluid from a first fluid passage, away from a second fluid passage, and into the planetary gear system.

* * * * *